US005299326A

United States Patent [19]

Alexander

[11] Patent Number: 5,299,326

[45] Date of Patent: Apr. 5, 1994

[54] VEHICLE TOILET VENT APPARATUS

[76] Inventor: Alton L. Alexander, 502 Majestic Blvd., Lafayette, La. 70508

[21] Appl. No.: 920,654

[22] Filed: Jul. 28, 1992

[51] Int. Cl.[5] ..... E03D 9/04

[52] U.S. Cl. ..... 4/209 R; 454/344; 4/219; 4/218

[58] Field of Search ..... 4/210, 211, 218, 219, 4/209, 213; 454/341, 344; 220/DIG. 27, 913; 137/209, 216.2, 217, 493.7, 526

[56] References Cited

U.S. PATENT DOCUMENTS

| | | | |
|---|---|---|---|
| 281,027 | 7/1883 | Cottier | 4/218 X |
| 949,212 | 2/1910 | Bogart . | |
| 3,571,822 | 3/1971 | Shaw | 4/213 |
| 4,042,981 | 8/1977 | Cook | 4/209 R X |
| 4,759,272 | 7/1988 | Zaniewski | 454/344 |
| 4,922,557 | 5/1990 | Harding et al. | 4/218 X |
| 4,962,548 | 10/1990 | Van Deventer et al. | 137/526 X |
| 4,974,632 | 12/1990 | Ericson | 4/218 X |
| 4,991,623 | 2/1991 | Ericson | 4/211 X |

*Primary Examiner*—Charles E. Phillips
*Attorney, Agent, or Firm*—Robert Montgomery

[57] ABSTRACT

The disclosed invention describes a vehicle waste tank ventilation exhaust fan, having the unique ability to provided positive exhaust on a continuous basis while diluting the contaminated air and odor being emitted by the waste tank with fresh air at a ratio in excess of five to one. A vacuum is drawn on the tank when the flush valve is closed by a small fan located over the tank vent pipe. A mixing chamber within the fan housing allows the fan to mix fresh air with odor from the tank and expel the odorous mixture over several hours.

8 Claims, 7 Drawing Sheets

VEHICLE TOILET VENT APPARATUS

BACKGROUND OF THE INVENTION

1. Field of the Invention

This invention relates to the venting of toilet waste tanks or other such waste systems in which noxious odors and gases are vented to the atmosphere, and more particular to the positive ventilation of vehicle waste tanks in which human waste is maintained for some period of time.

2. General Background

Portable toilets used in conjunction with recreational vehicles o such as boats and campers generally comprise a relatively small room within which is housed the toilet facility. The sewage collected from the toilet is kept within a holding tank mounted below the toilet facility. From time to time the holding tank must be dumped by draining its contents into a sewer system.

When the recreational vehicle, boat etc. is exposed to heat such as during the summer months, when they are the most active, the sewage within the holding tank becomes bacteriologically active resulting in noxious odors. Chemicals are usually added to help naturalize the odor and speed the biodegradation of toilet paper. Until recently formaldehyde, a hazardous chemical, was the chemical of choice to control such odor.

Usually, the holding tanks are vented to atmosphere, by way of a vent pipe, to allow for the dissipation of gases and odor. However, a vent pipe alone does not solve the problem of noxious odor, chemically treated or not, from backing up into the room where the toilet is housed. Whenever, the toilet gate valved is opened to allow waste to enter the holding tank the noxious chemically laden odors rise, permeating entire area. In addition these odors are constantly being emitted into the air around the vehicle.

A primary object of the prior art, in most cases, is to provide a ventilation system for portable or vehicle toilets whereby any noxious odors or gases are positively expelled. To do this, various methods of ventilation have been employed, such as vent fans mounted in or over the tank vent pipe and forced draft suction created by the movement of air passing over vent pipes or ducts.

The need for positive ventilation, in vehicles or portable toilets, sometimes referred to as black water tanks, has been acknowledged in such as U.S. Pat. No. 4,042,981 which utilizes a vent fan blowing across a tank vent tube, U.S. Pat. No. 949,212 which utilizes a fan, mounted inside the vent tube and rotated by a wind turbine, to remove odors and U.S. Pat. No. 4,922,557 which utilizes solar panels to power a fan located on top of the exhaust vent. Each of the above patents attempt to achieve positive ventilation of the toilet tank and/or the water closet in which it is located.

Through toilet cleaning of the waste tank is an unpleasant task at best but is particularly obnoxious if the tank is not continuously being positively vented. This operation is accomplished when the toilet gate valve is opened, allowing access to the tank, where a water hose with a nozzle attachment is used to swab the tank during the dumping operation. Without positive ventilation at all times, toilet odor becomes offensive inside the vehicle or portable toilet. Recreational vehicle users have come to rely on chemicals to reduce the holding tank odor to reasonable levels and therefore, expect and accept such chemical odors. Newer chemicals, considered to be more biodegradable and non-hazardous, are now being substituted for the formaldehyde formula. However, we can never be sure if they too will not have some side effects on humans or our environment.

The prior art, fails to address the critical problem of what should be done with the odor once it is removed from the vehicle. Simply exhausting such odors into the surrounding air may be sufficient when the vehicle is moving. However, such practice is clearly unacceptable when the vehicle is parked for several days. Constant atmosphere emission in an area with little wind circulation can be just as unpleasant as being near the toilet. Recreational vehicles are seldom parked alone, thus, such odors are combined when several vehicles congregate. Anyone attempting to enjoy the great outdoors, when surrounded by vehicles exhausting noxious and/or chemical odors, may find the air to be very unpleasant.

Therefore, one object of the present invention is to provide a means of positively exhausting toilet odor in a manner which provides for the dilution of the waste tank odor.

A further object of the present invention is to provide a continuous operating toilet exhaust fan that does not interfere with television or stereo equipment.

It is a further object of the present invention to reduce the dependence on chemicals used in vehicle holding tanks with better distribution. Thus, the amount of chemicals required to reduce toilet odor can be reduced.

SUMMARY OF THE PRESENT INVENTION

The present invention, a Vehicle toilet tank vent exhausting apparatus comprises a fan housing, for mounting over the exhaust end of a sewage tank vent pipe. The apparatus having an internal fan, arranged in a manner that allows the odorous fumes from the toilet holding tank to be evacuated from the tank and mixed with large quantities of fresh air, at ratios in excess of five to one, as they are being discharged into the atmosphere. Thus, noxious odor is dissipated over a relatively long period of time. An important characteristic of the present invention is its ability to maintain a vacuum on the waste tank system, thereby, preventing back flow of noxious odors into the living area of the vehicle. Thus, preventing such noxious waste or chemical odors from permeating everything in the vehicle.

Another embodiment of the present invention provides a means for continuous repetition and further dilution with only minimum discharge. This type system would be employed if the vehicle or waste tank is expected to be located in a heavily congested area. The apparatus further provides a means of controlling the fan speed allowing for continuous operation during the camping mode with higher speeds for traveling and dump modes.

The continuous operation camping mode allows the vent fan to maintain a positive vent exhaust, even when the flush valve is open. Thereby, preventing odor from re-entering the toilet.

The traveling mode provides a slightly higher fan speed, in order to maintain a positive exhaust while traveling, preventing air from being forced down the vent pipe and into the toilet tank.

The dump mode is even a higher fan speed to insure positive exhaust even when dumping and swabbing the black water tank.

The traveling mode may not be necessary unless air flow across the vent pipe is blocked in some manner. By providing positive ventilation on a continuous basis as described, back flow of contaminated air into a Recreation Vehicle's living area is eliminated.

Although the present invention is well suited for use on Recreational Vehicles it can be adapted to almost any sewage holding tank ventilation system.

DETAILED DESCRIPTION OF THE PREFERRED EMBODIMENT

Figure 1:
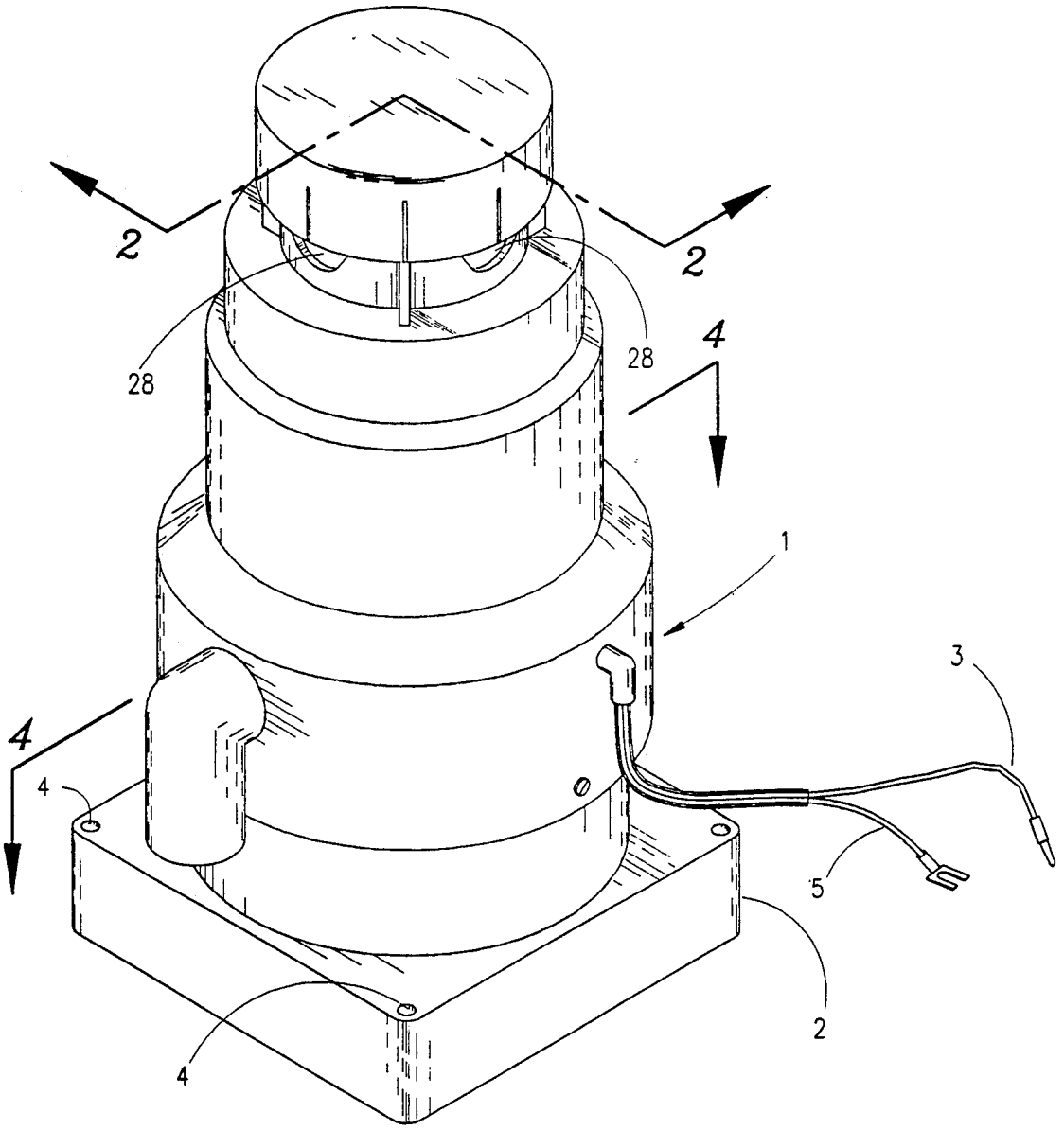
FIG. 1 is an isometric view of the exhaust fan unit.
Figure 2:
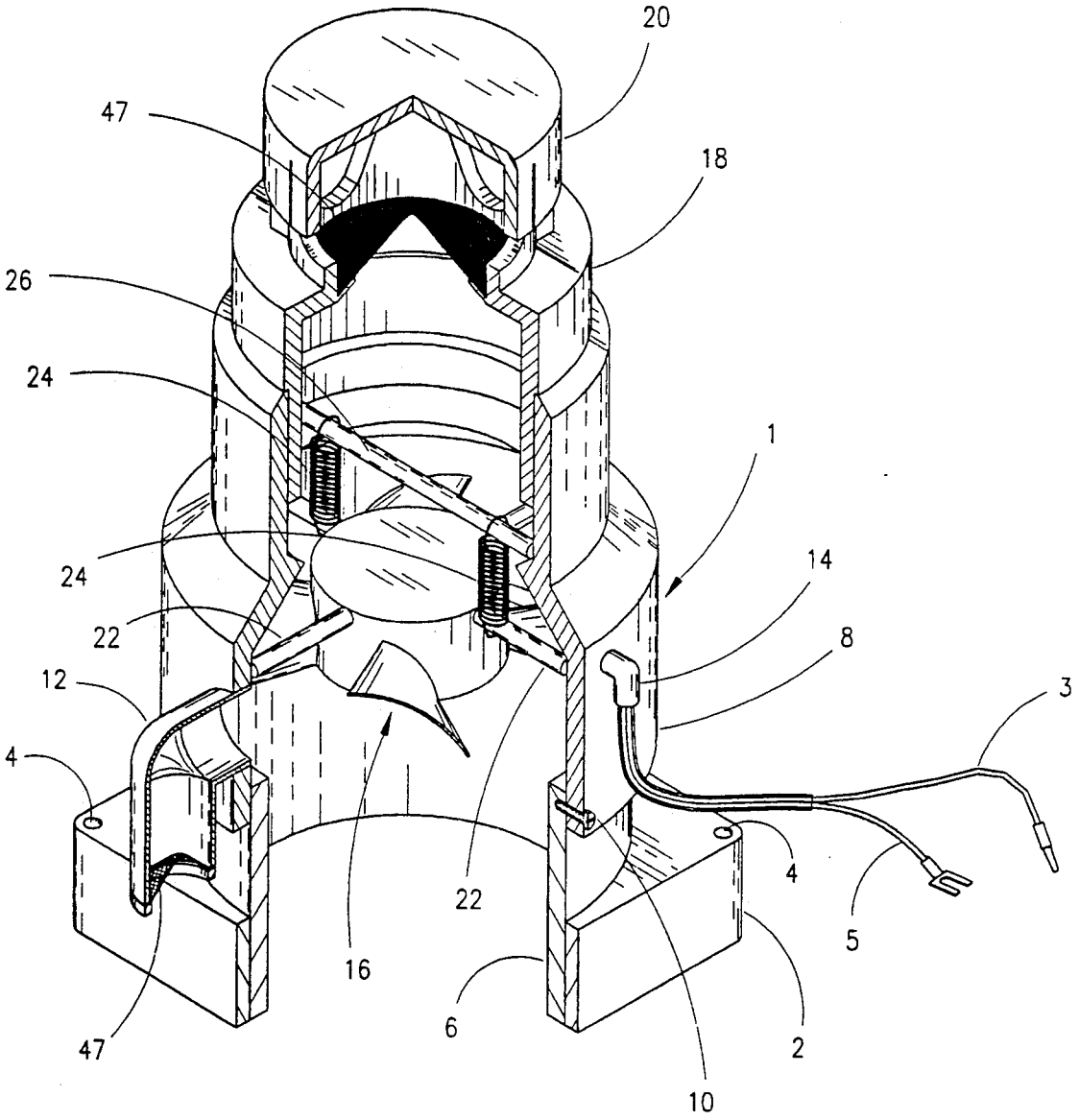
FIG. 2 is an isometric view of a cut-a-way section view taken along sight line 2—2 shown in FIG. 1.

As shown in FIGS. 1 and 2 the vent fan housing assembly 1 of the preferred embodiment is comprised of three body elements: a base section 2 having mounting holes 4 and a raised vertical rim 6; an intermediate section 8, telescopically fitted over said base section 2 and secured thereto by a set screw o, and further fitted with an exhaust port fitting 2, a wiring port fitting 4, and a fan assembly 16 mounted internally therein; and an upper section 8, telescopically inserted into said intermediate section 8, upon which is mounted a vent cap 20.

Figure 4:
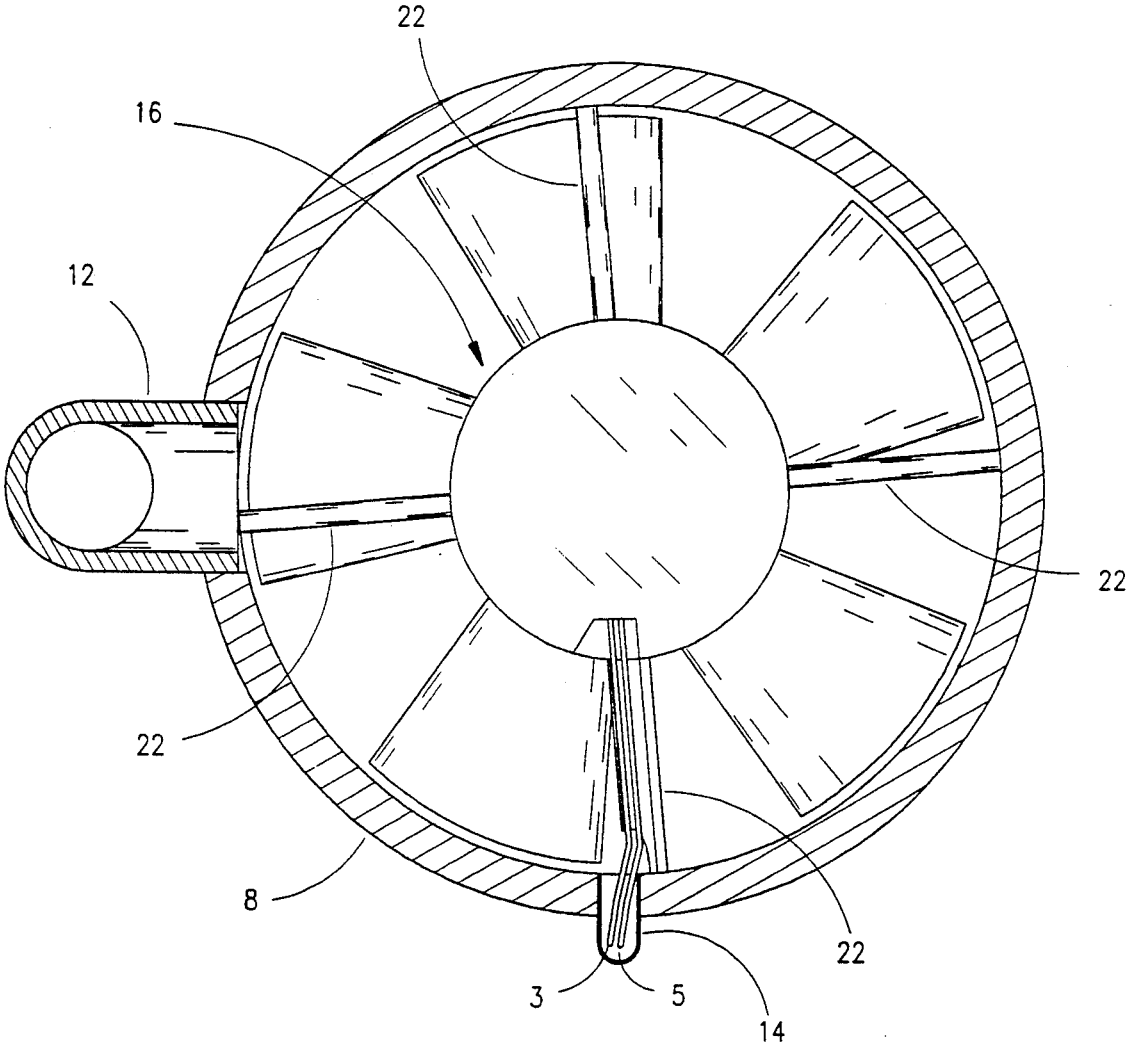
FIG. 4 is a cross section view of the vent fan unit taken along sight lines 4—4 as shown in FIG. 1.

The fan assembly 6 as exposed in section in FIG. 4 is maintained and securely centered in the body cavity of said intermediate section 8 by struts 22, supported by biasing means 24 suspended from a support cross bar 26.

It is important to note that the inlet end of said exhaust port fitting 12, is located perpendicular to the axial flow of the air flow of the exhaust fan and should be positioned in a manner so as to be flush with curvature of the inner wall of the intermediate section 8. The exhaust port fitting 2 is fitted with a filter screen 47 as is the upper section 18. Power is supplied to the vent fan 16 via connecting wire 3 and positively grounded by a wire 5 secured to one of the mounting screws in the base section 2. The power wire 5 is passed through the roof portion 27 of the vehicle and into the wall cavity 33 in which the vent pipe 31 is located and connected to the speed control apparatus 29. The speed control apparatus 29 is located in near proximity to the toilet and is further connected to a 6 or 12 volt d.c. power circuit wire 7 within the vehicle.

Figure 3:
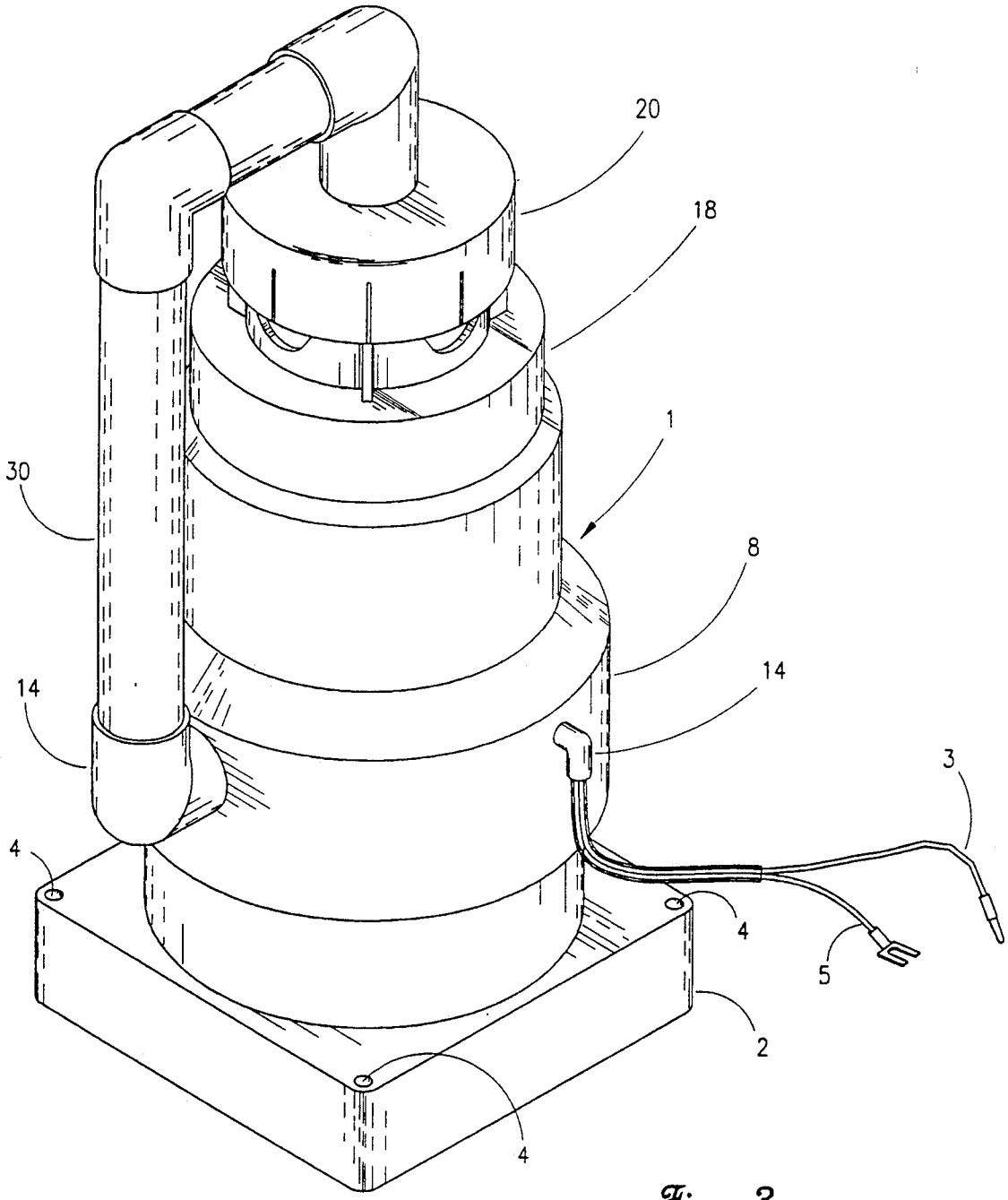
FIG. 3 is an isometric view of a second embodiment of the exhaust fan unit utilizing a recirculating adaptor.
Figure 5:
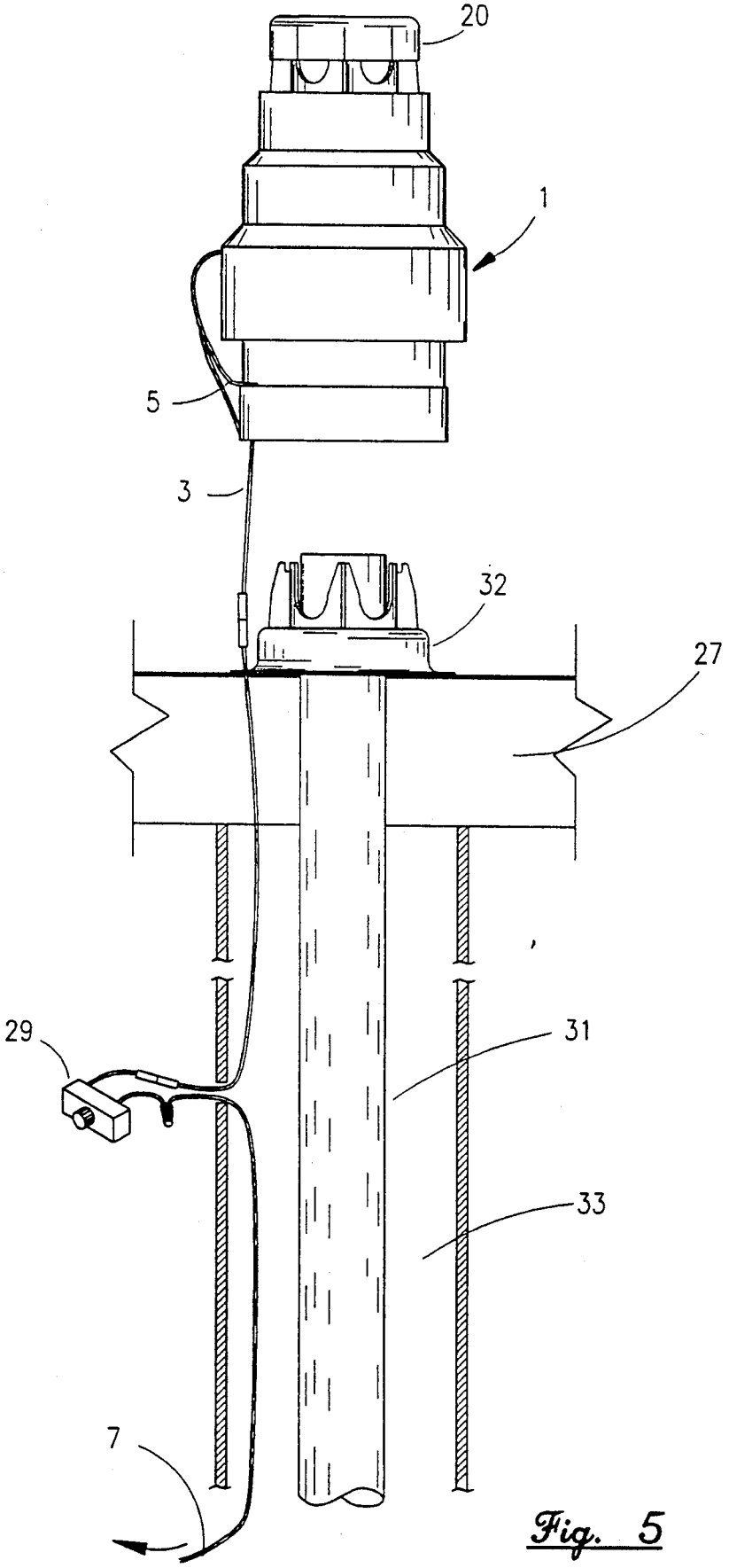
FIG. 5 is elevation view of the fan unit installation arrangement in conjunction with fan speed control unit and cross section view of a vehicle wall exposing wiring and an existing tank vent pipe fitted with typical vent collar.
Figure 6:
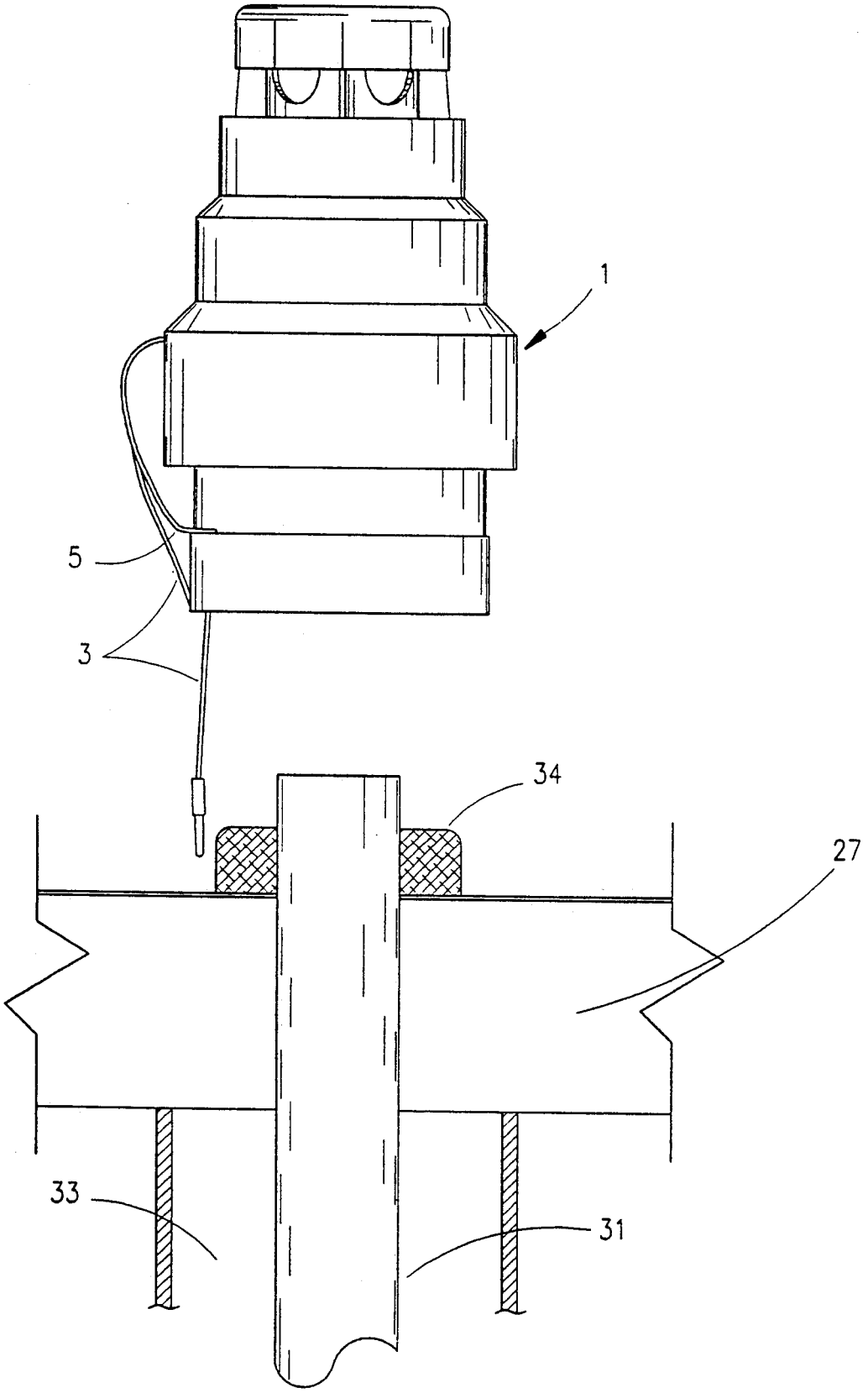
FIG. 6 is an elevation view of the vent fan unit and a cross section of an existing vehicle wall exposing a tank vent pipe with a sealing means, used when no vent collar is available.
Figure 7:
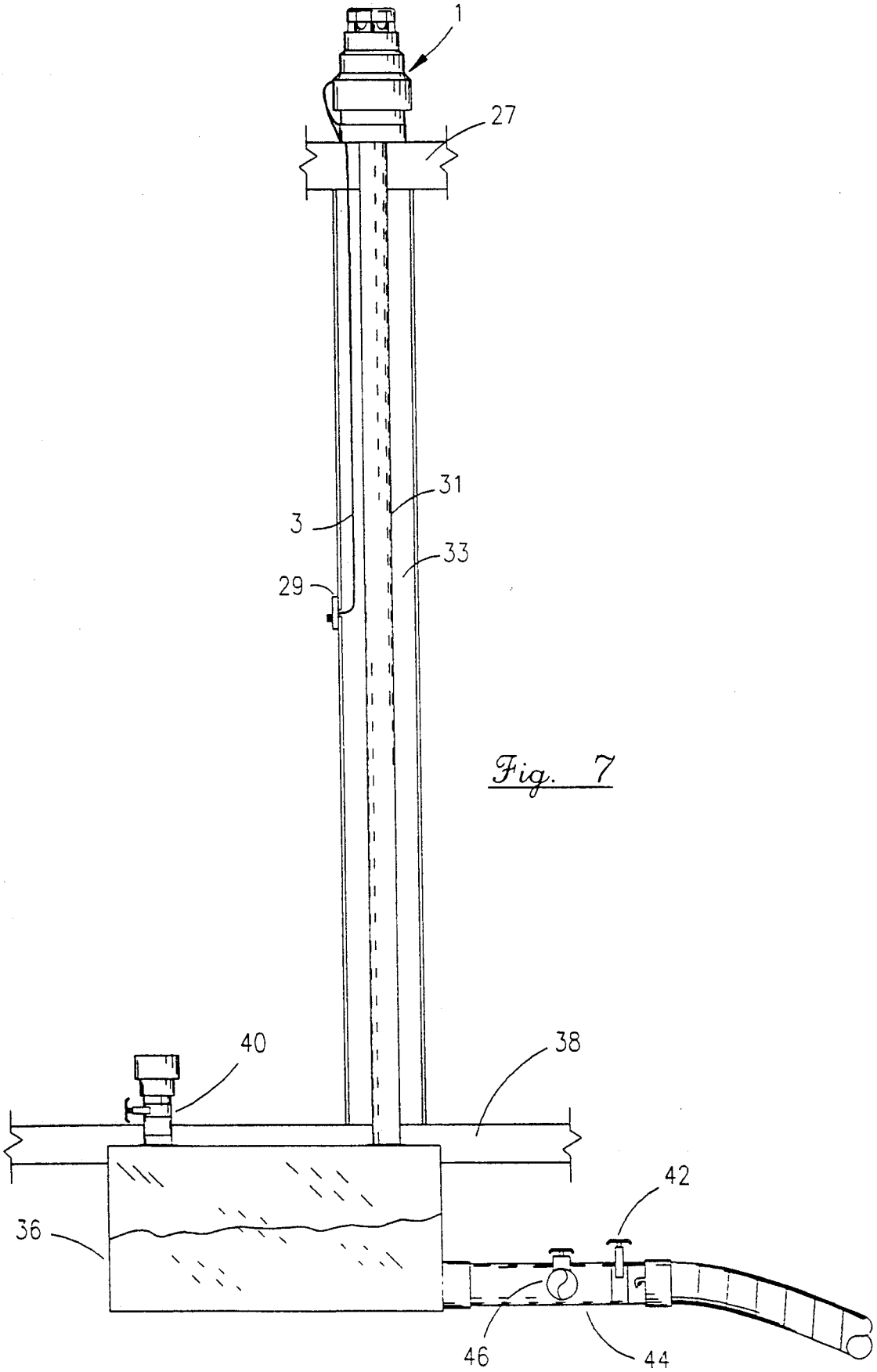
FIG. 7 is an elevation view of the vent fan unit and a cross section of an existing vehicle wall, ceiling and floor depicting a waste tank and vent assembly with the present invention installed.

The present invention when installed over an existing toilet vent pipe 31 as seen in FIG. 5 having an existing vent collar 32, or a sealing collar 34 supplied with the vent fan as shown installed in FIG. 6, has the unique ability to operate as an exhaust vent and to provide a dilution operation by mixing the exhausted odor or fumes with fresh air. The principle of operation is as follows: The vent fan 16 continuously draws air from the toilet's black water tank 36. Thereby, providing positive ventilation of the tank and exhausting any odorous fumes being emitted therefrom, through the apparatus's upper portion exhaust/intake port 28. When the flush valve 40 as shown in FIG. 7 and dump valves 4 are closed, thereby, creating a sealed tank 36, all the air in the tank 36 is soon exhausted and a vacuum will be created on the tank 36. The fan 16 will then began to cavitate or go into a null state in which no air is being exhausted through the exhaust/intake port 28. At this point air begins to be drawn from the exhaust/intake port 28 and mixed with odorous fumes or vapors from the tank 36 currently being cavitated by the fan 16 in the mixing chamber located just below the fan 16 composed of, the base section 2 and the intermediate section 8, and discharged to atmosphere through the exhaust port fitting 12 located on the side of the intermediate section 8 over a period of several hours. The ratio of fresh air to contaminated air from the black water tank 36 is approximately five to one. However, it is evident that cavity and fan 16 sizes could be varied to change the ratio. It has also been found that by re-routing the exhaust port 12 in a manner as shown in FIG. 3 and directing all exhaust air through a duct work 30 back into the intake cap 20, an even greater ratio of dilution can be achieved. The use of a brushless low torque fan motor 16 allows the exhaust fan unit 1 to be used continuously without interfering with radio stereo, or T. V. reception. The fan speed control 29 allows for three defined modes of operation; camping, traveling, and dumping.

What is claimed is:

1. A sealed toilet waste tank ventilation apparatus for mounting over an existing recreational vehicle black water tank vent, said apparatus comprising;
   a) an exhaust fan housing, having at least one exhaust port;
   b) a mixing chamber, located inside said exhaust fan housing;
   c) an electrical fan, located within said mixing chamber, and causing air flow upwardly in said tank vent;
   d) said at least one exhaust port communicating said fan with the ambient above said fan;
   e) a further exhaust port exiting said mixing chamber, perpendicular to said upward flow produced by said fan,
   f) wherein when said fan draws a vacuum in said tank, ambient air will be drawn into said mixing chamber through said at least one port and expelled through said further exhaust port.

2. A waste tank ventilation apparatus as recited in claim 1, wherein said housing comprises at least two exhaust ports.

3. A waste tank ventilation apparatus as recited in claim 1, wherein said apparatus is mountable over an existing vent pipe and collar.

4. A waste tank ventilation apparatus as recited in claim 1, further including a control means, located remotely, for controlling the speed of said exhaust fan.

5. A waste tank ventilation apparatus as recited in claim 4 wherein said exhaust fan speed control means has three specified mode settings; camping, traveling and dumping.

6. A waste tank ventilation apparatus as recited in claim 5, wherein said exhaust port exiting said mixing chamber is piped into the upper exhaust/intake port cover.

7. A toilet waste tank ventilation apparatus for mounting over an existing recreational vehicle black water tank as recited in claim 1, wherein said electrical fan is a brushless motor with a fan having a plurality of blades mounted thereon.

8. A toilet waste tank ventilation apparatus for mounting over an existing recreational vehicle black water tank vent as recited in claim 1, wherein said fan mixes fresh air and waste tank odorous fumes within said mixing chamber at a ratio of at least five parts fresh air to one part odor while discharging under sealed tank conditions.

* * * * *